US007553592B2

(12) United States Patent
Aziz et al.

(10) Patent No.: US 7,553,592 B2
(45) Date of Patent: Jun. 30, 2009

(54) PHOTORECEPTOR WITH ELECTRON ACCEPTOR

(75) Inventors: Hany Aziz, Oakville (CA); Gregory McGuire, Oakville (CA); Johann Junginger, Toronto (CA)

(73) Assignee: Xerox Corporation, Norwalk, CT (US)

( * ) Notice: Subject to any disclaimer, the term of this patent is extended or adjusted under 35 U.S.C. 154(b) by 418 days.

(21) Appl. No.: 11/422,247

(22) Filed: Jun. 5, 2006

(65) Prior Publication Data

US 2007/0281226 A1 Dec. 6, 2007

(51) Int. Cl.
*G03G 5/047* (2006.01)

(52) U.S. Cl. ..... 430/58.05; 430/58.25; 430/58.4; 430/59.1; 430/66.73

(58) Field of Classification Search ..... 430/58.05, 430/58.25, 58.4, 59.1, 66, 73
See application file for complete search history.

(56) References Cited

U.S. PATENT DOCUMENTS 3,121,006 A 2/1964 Middleton et al.
3,624,226 A * 11/1971 Hoover et al. ..... 430/73
4,050,935 A 9/1977 Limburg et al.
4,281,054 A 7/1981 Horgan et al.
4,297,425 A 10/1981 Pai et al.
4,298,697 A 11/1981 Baczec et al.
4,338,390 A 7/1982 Lu
4,560,635 A 12/1985 Hoffend et al.
4,599,286 A 7/1986 Limburg et al.
4,897,289 A * 1/1990 Aumueller et al. ..... 427/125
5,525,447 A * 6/1996 Ikuno et al. ..... 430/67
5,561,016 A * 10/1996 Suzuki et al. ..... 430/58.85
5,681,679 A 10/1997 Schank et al.
5,702,854 A 12/1997 Schank et al.
5,702,855 A * 12/1997 Ikegami et al. ..... 430/83
5,840,455 A * 11/1998 Ikuno et al. ..... 430/67
5,976,744 A 11/1999 Fuller et al.
2004/0043313 A1 * 3/2004 Zhu et al. ..... 430/57.2
2005/0053854 A1 * 3/2005 Pai et al. ..... 430/58.65

* cited by examiner

*Primary Examiner*—Hoa V Le
(74) *Attorney, Agent, or Firm*—Oliff & Berridge, PLC

(57) ABSTRACT

An electrophotographic imaging member includes at least one layer including a hole transport material and a strong electron acceptor material, such as an electrophotographic imaging member including a substrate, a charge generating layer, a hole transport layer, and an optional overcoating layer, wherein at least one layer of the electrophotographic imaging member comprises a strong electron acceptor material.

18 Claims, No Drawings

PHOTORECEPTOR WITH ELECTRON ACCEPTOR

TECHNICAL FIELD

This disclosure is generally directed to electrophotographic imaging members and, more specifically, to layered photoreceptor structures where at least one layer such as the hole transport layer includes a strong electron accepting material. This disclosure also relates to processes for making and using the imaging members.

REFERENCES

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,681,679 discloses a flexible electrophotographic imaging member including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may he utilized in an imaging process including forming an electrostatic latent image on the imaging member, depositing toner particles on the imaging member in conformance with the latent image to form a toner image, and transferring the toner image to a receiving member.

U.S. Pat. No. 5,976,744 discloses an electrophotographic imaging member including a supporting substrate coated with at least one photoconductive layer, and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating. The electrophotographic imaging member may be imaged in a process.

U.S. Pat. No. 4,297,425 discloses a layered photosensitive member comprising a generator layer and a transport layer containing a combination of diamine and triphenyl methane molecules dispersed in a polymeric binder.

U.S. Pat. No. 4,050,935 discloses a layered photosensitive member comprising a generator layer of trigonal selenium and a transport layer of bis(4-diethylamino-2-methylphenyl) phenylmethane molecularly dispersed in a polymeric binder.

U.S. Pat. No. 4,281,054 discloses an imaging member comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,599,286 discloses an electrophotographic imaging member comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

The disclosures of each of the foregoing patents are hereby incorporated by reference herein in their entireties. The appropriate components and process aspects of the each of the foregoing patents may also be selected for the present compositions and processes in embodiments thereof.

BACKGROUND

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and other materials. In addition, the imaging member may be layered in which each layer making up the member performs a certain function. Current layered organic imaging m embers generally have at least a substrate layer and two electro or photo active layers. These active layers generally include (1) a charge generating layer containing a light-absorbing material, and (2) a charge transport layer containing charge transport molecules or materials. These layers can be in a variety of orders to make up a functional device, and sometimes can be combined in a single or mixed layer. The substrate layer may be formed from a conductive material. Alternatively, a conductive layer can be formed on a nonconductive inert substrate by a technique such as but not limited to sputter coating.

The charge generating layer is capable of photogenerating charge and injecting the photogenerated charge into the charge transport layer or other layer.

In the charge transport layer, the charge transport molecules may be in a polymer binder. In this case, the charge transport molecules provide hole or electron transport properties, while the electrically inactive polymer binder provides mechanical properties. Alternatively, the charge transport layer can be made from a charge transporting polymer such a vinyl polymer, polysilylene or polyether carbonate, wherein the charge transport properties are chemically incorporated into the mechanically robust polymer.

Imaging members may also include a charge blocking layer(s) and/or an adhesive layer(s) between the charge generating layer and the conductive substrate layer. In addition, imaging members may contain protective overcoatings, These protective overcoatings can be either electroactive or inactive, where electroactive overcoatings are generally preferred. Further, imaging members may include layers to provide special functions such as incoherent reflection of laser light, dot patterns and/or pictorial imaging or subbing layers to provide chemical sealing and/or a smooth coating surface.

Imaging members are generally exposed to repetitive electrophotographic cycling, which subjects the exposed charge transport layer or alternative top layer thereof to mechanical abrasion, chemical attack and heat. This repetitive cycling leads to a gradual deterioration in the mechanical and electrical characteristics of the exposed charge transport layer.

Although excellent toner images may be obtained with multilayered belt or drum photoreceptors, it has been found that as more advanced, higher speed electrophotographic copiers, duplicators and printers are developed, there is a greater demand on copy quality. A delicate balance in charging image and bias potentials, and characteristics of the toner and/or developer, must be maintained. This places additional constraints on the quality of photoreceptor manufacturing, and thus, on the manufacturing yield.

Despite the various approaches that have been taken for forming imaging members, there remains a need for improved imaging member design, to provide improved imaging performance, longer lifetime, and the like.

SUMMARY

This disclosure addresses some or all of the above problems, and others, by providing imaging members where at least one layer, such as the charge transport layer, includes a strong electron accepting material.

In an embodiment, the present disclosure provides an electrophotographic imaging member comprising at least one layer comprising:

a hole transport material, and a strong electron acceptor material.

In another embodiment, the present disclosure provides an electrophotographic imaging member comprising:

a substrate, a charge generating layer, a hole transport layer, and an optional overcoating layer wherein at least one layer of the electrophotographic imaging member comprises a strong electron acceptor material.

The present disclosure also provides electrographic image development devices comprising such electrophotographic imaging members. Also provided are imaging processes using such electrophotographic imaging members.

In another embodiment, the present disclosure provides a process for forming an electrophotographic imaging member comprising:

providing an electrophotographic imaging member substrate, and applying a generating layer and a hole transport layer over the substrate, wherein at least one layer of the electrophotographic imaging member comprises a strong electron acceptor material.

EMBODIMENTS

Electrophotographic imaging members are known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a hole transport layer is formed on the charge generation layer, followed by an optional overcoat layer. This structure may have the charge generation layer on top of or below the hole transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be about 20 angstroms to about 750 angstroms, such as about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer known in the art may be utilized. Typical adhesive layer materials include, for example, polyesters, polyurethanes and the like. Satisfactory results may be achieved with adhesive layer thickness of about 0.05 micrometer (500 angstroms) to about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer is formed on the adhesive layer, blocking layer or substrate. The electrophotographic imaging layer may be a single layer that performs both charge generating and hole transport functions as is known in the art or it may comprise multiple layers such as a charge generator layer and hole transport layer. Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, such as from about 20 percent by volume to about 30 percent by volume of the photogenerating pigment dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photo generating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The hole transport layer comprises a bole transporting small molecule dissolved or molecularly dispersed in a film forming electrically inert polymer such as a polycarbonate. The term "dissolved" as employed herein is defined herein as forming a solution in which the small molecule is dissolved in the polymer to form, a homogeneous phase. The expression "molecularly dispersed" as used herein is defined as a hole transporting small molecule dispersed in the polymer, the small molecules being dispersed in the polymer on a molecular scale. Any suitable hole transporting or electrically active small molecule may be employed in the hole transport layer. The expression hole transporting "small molecule" is defined herein as a monomer that allows the free charge photogenerated in the transport layer to be transported across the transport layer. Typical hole transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. As indicated above, suitable electrically active small molecule hole transporting compounds are dissolved or molecularly dispersed in electrically inactive polymeric film forming materials. Small molecule hole transporting compounds that permit injection of holes from the pigment into the charge generating layer with high efficiency and transport them across the hole transport layer with very short transit times are N,N'-diphenyl-N,N'-bis(3-methylphenyl)-(1,1'-biphenyl)-4,4'-diamine, N,N,N',N'-tetra-p-tolylbiphenyl-4,4'-diamine, and N,N'-Bis(3-methylphenyl)-N,N'-bis[4-(1-butyl)phenyl]-[p-terphenyl]-4,4'-diamine. If desired, the hole transport material in the hole transport layer may comprise a polymeric hole transport material or a combination of a small molecule hole transport material and a polymeric hole transport material.

Any suitable electrically inactive resin binder insoluble in the alcohol solvent used to apply the overcoat layer may be employed in the hole transport layer. Typical inactive resin binders include polycarbonate resin, polyester, polyarylate, polysulfone, and the like. Molecular weights can vary, for example, from about 20,000 to about 150,000. Exemplary binders include polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4, 4'-isopropylidene-3,3'-dimethyl-diphenyl)carbonate (also referred to as bisphenol-C-polycarbonate) and the like. Any suitable hole transporting polymer may also be utilized in the hole transporting layer. The hole transporting polymer should be insoluble in any solvent employed to apply the subsequent overcoat layer described below, such as an alcohol solvent. These electrically active hole transporting polymeric materials should be capable of supporting the injection of photogenerated holes from the charge generation material and be incapable of allowing the transport of these holes therethrough.

Any suitable and conventional technique may be utilized to mix and thereafter apply the hole transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the hole transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is desirably maintained from about 2:1 to 200:1 and in some instances as great as 400:1. The hole transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

In accordance with embodiments, a strong electron accepting material is also dispersed in at least one layer of the photoreceptor, to provide improved electrical properties to the photoreceptor. In embodiments, the strong electron accepting material can be dispersed in any of the photoreceptor layers, such as an undercoating layer, an overcoating layer, or the photogenerating layer. However, in particular embodiments, the strong electron accepting material is incorporated or dispersed in the hole transport layer and/or in an overcoating layer along with the hole transporting small molecule.

When so incorporated, the strong electron accepting material can be incorporated into the whole layer, such as to make a uniform dispersion of the strong electron accepting material in the layer, or it can be incorporated into the layer in a varying amount to make a concentration gradient of the strong electron accepting material in the layer. In these embodiments, there would thus be a relatively larger amount or concentration of the strong electron accepting material in one portion of the layer, and a relatively smaller amount or concentration of the strong electron accenting material in another portion of the layer, such as in radially inner and outer portions of the layer. In other embodiments, the layer can be provided in two or more distinct sub-layers, where the two or more distinct sub-layers include different amounts or concentrations of the strong electron accepting material. In these embodiments, the thicknesses of the two or more different sub-layers can have any proportions relative to the whole thickness and to each other. For example, the strong electron accepting material in these embodiments can be restricted to only a portion of the overall layer, such as an overall hole transport layer and/or an overcoating layer. In embodiments, the use of sub-layers allows the strong electron accepting material to be restricted to, for example, from about 1 or about 5 to about 50 or about 75% or more of the overall layer thickness. Thus, for example, a thickness ratio of a thickness of the sub-layer containing the strong electron acceptor material to a thickness of a sub-layer not containing the strong electron acceptor material is from about 1:99 to about 99:1, or about 5:95 to about 95:5, or about 25:75 to about 75:25. Restricting the strong electron accepting material to only a portion of the overall layer thickness can be useful, for example, to help provide a photoreceptor with lower residual voltage values (such as from about 0 to about 5 volts or front about 0 to about 3 volts) and/or reduced cycling changes, while still providing minimal undesired increases in dark decay, such as a dark decay of from about 0 to about 30 volts. However, some of these benefits can be provided without restricting the strong electron accepting material to only a portion of the overall layer thickness.

The term "strong electron accepting material" refers, for example, to a material or chemical species that is capable of oxidizing another material that co-exists in the same layer of a photoreceptor device, where that other material is typically a hole transport material, such as, for example a hole transport material in a hole or charge transport layer or an overcoating layer. It is believed that the capacity of the strong electron accepting material to oxidize the hole transport material arises from the strong electron affinity of the strong electron accepting material. In embodiments, the electron affinity is, for example, no less than about 2 electron Volts (eV), and typically no less than about 3 eV, and sometimes no less than about 5 eV. There is generally no upper limit, although the electron affinity is, for example, no more than about 15 electron Volts (eV), and typically no more than about 10 eV. Such strong electron accepting materials are sometimes characterized by having a lowest unoccupied molecular orbital (LUMO) that has an energy, $E_{LUMO}$, of no less than about 2 eV versus the vacuum energy level $E_{VAC}$ (where energy of $E_{VAC}$ is taken, by convention, as 0 eV), and typically no less than about 3 eV, and sometimes no less than about 5 eV.

Suitable examples of such strong electron accepting materials include, but are not limited to, Tetracyanoquinonedimethane (TCNQ) and its derivatives, such as the fluorinated TCNQ-analog 2,3,5,6-tetrafluoro-7,7,8,8-tetracyanoquinonedimethane (sometimes referred to as F4TCNQ), and organometal complexes of TCNQ, such as M-TCNQ where M represents a metal such as Li, Na, K, Ag, Cu, or Fe. Other suitable examples of such strong electron accepting materials include Lewis acid compounds such as $FeCl_3$, $AlCl_3$, $AlBr_3$, $BF_3$, $BF32C_6H_5OH$, $BF_3[O(C_2H_5)_2]_2$, $TiCl_4$, $SnCl_4$, $AlC_2H_5Cl_2$, $SbCl_5$, $SbF_5$, $ZrCl_4$, $HfCl_4$, $NbCl_5$, $TaCl_5$, $MoCl_5$, and $WCI_6$ and the like. Other suitable examples of such strong electron accepting materials include fullerenes, such as, for example, $C_{60}$ and $C_{70}$ and their derivatives. Other strong electron acceptor materials include iodine, tris(4-bromophenyl)ammonium hexachloroantimonate (TBAHA), quinones fused with sulfur containing heterocycles, N,N'-dicyanoquinone diimine (DCNQi) analogues, radialenes containing a sulphur, selenium or tellurium atoms and others like those described by Yamashita and Tomura [J. Material Chemistry, Volume 8, pages 1933-1944 (1998)] and others.

In forming the layer containing the strong electron accepting material, the strong electron accepting material can be simply mixed with the other layer components to forms a uniform or substantially uniform dispersion, and thereafter applied to form the layer. For example, where the strong electron accepting material is included in a hole transport layer, the strong electron accepting material can be mixed with the hole transport material and applied to form the hole transport layer. In other embodiments, however, it may be desirable to first form a solution of the strong electron accepting material in a suitable solvent, such as $CH_2Cl_2$, and then to mix the resultant solution with the other layer components to form a layer-forming composition. These two-step process can be used to help ensure complete mixing of the strong electron accepting material in the layer-forming composition.

The strong electron accepting material can be included in the respective photoreceptor layer in any desired amount, such as from greater than 0% up to about 10% or up to about 20% by weight oft the final applied layer. However, much smaller amounts of the strong electron accepting material can be used in forming the layers. Thus, for example, in embodiments, the strong electron accepting material can be present in an amount of from greater than 0% up to about 1%, such as up to about 0.5% up to about 0.1% by weight, or up to about 0.025 or up to about 0.05%, by weight of the total solid content of the layer. Of course, other amounts can be used as desired To improve photoreceptor wear resistance, a protective overcoat layer can be provided over the hole transport layer (or other underlying layer). Various overcoating layers are known in the art, and can be used as long as the functional properties of the photoreceptor are not adversely affected.

Advantages provided by the present disclosure include, in embodiments, photoreceptors having desirable electrical and function properties. For example, photoreceptors in embodiments have one or more of (i) a low residual voltage (Vr) value, such as from about 0 to about 10 volts or from about 0 to about 5 volts or from about 0 to about 3 volts, (ii) reduced cycling changes over at least about 10,000 cycles, such as, for example a cycling-up change (increase) in Vr of no more than 15 Volts when cycled for about 10,000 cycles.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298,697 and 4,338,390, the disclosures of which are totally incorporated herein by reference; subsequently transferring the image to a suitable substrate; and permanently affixing the image thereto. In those environments wherein the device is to be used in a printing mode, the imaging method involves the same steps with the exception that the exposure step can be accomplished with a laser device or image bar.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Comparative Example 1

Preparation of Hole Transport Layer Composition

A hole transport layer coating solution is prepared by introducing into an amber glass bottle a weight ratio of 1:1 N,N'-diphenyl-N,N'-bis(3-methylphenyl)-1,1'-biphenyl-4~4'-diamine, and Makrolon 5707, a polycarbonate resin having a weight average molecular weight of about 120,000 commercially available from Bayer A.G. The resulting mixture is dissolved to give a 15 percent by weight solid in 85 percent by weight methylene chloride.

Example 1

Preparation of Hole Transport Layer Compositions with Strong Electron Acceptor Material Four hole transport layer coating solutions are prepared in the same manner as Comparative Example 1, by introducing into an amber glass bottle a weight ratio of 1:1 N,N'-diphenyl-N,N'-bis(3-methylphenyl)-1,1'-biphenyl-4~4'-diamine, and Makrolon 5707, a polycarbonate resin having a weight average molecular weight of about 120,000 commercially available from Bayer A.G. The resulting mixture is dissolved to give a 15 percent by weight solid in 85 percent by weight methylene chloride. To the mixture is added tetrafluorotetracyanoquinonedimethane (F4TCNQ) in amounts to form final solutions having 0.017, 0.025, 0.030, and 0.50% by weight F4TCNQ.

Example 2

Preparation of Imaging Members

Imaging member sheets or belts are formed using various of the hole transport layer coating compositions of Example 1 and Comparative Example 1. Each imaging member sheet or belt is formed as follows: A production machine coated PEN/Mylar/TiZr/Silane/Ardel substrate was provided and a HOGaPc/PCZ-200 photogenerating, layer was production machine coated over the substrate. A hole transport layer was hand coated on the charge generating layer using web coating methods. The hole transport layer coating compositions are applied as two sub-layers of thickness ratios of 10:90, 50:50, or 90:10, where a first sub-layer is denoted CTL1 and a second sub-layer is denoted CTL2. The respective solutions are applied onto the photogenerator layer to form a coating that upon drying has a total hole transport layer thickness of around 29 micrometers. In the various imaging member sheets or belts, the hole transport layer solutions used are as shown in the Table below. The coating was dried in a forced air oven for about 1 minute at about 120° C.

Device performance is evaluated using time zero PIDC measurements and long term electrical cycling over 10,000 cycles in ambient conditions. The imaging members are tested for their electrostatographic sensitivity and cycling stability in a scanner. The scanner is known in the industry and equipped with means to rotate the drum while it is electrically charged and discharged. The charge on the sample is monitored through use of electrostatic probes placed at precise positions around the circumference of the device. The samples in this Example are charged to a negative potential of 700 Volts. As the device rotates, the initial charging potential is measured by voltage probe 1, and then the potential after dark decay is measured by voltage probe 2, and the value of Vdd is calculated. The sample is then exposed to monochromatic radiation of known intensity, and the surface potential measured by voltage probes 3 and 4. Finally, the sample is exposed to all erase lamp of appropriate intensity and wavelength and any residual potential, Vr, is measure by voltage probe 5. The process is repeated under the control of the scanner's computer, and the data is stored in the computer. The PIDC (photo induced discharge curve) is obtained by plotting the potentials at voltage probes 3 and 4 as a function of the light energy.

The Table below includes the dark decay voltage (Vdd) and residual voltage (Vr) values. Only Vdd and Vr are shown here because other electrical characteristics remain essentially unchanged among the various configurations. From the results, it can be seen that the use of F4TCNQ substantially reduces Vr in all device configurations as compared to the reference device configurations (Samples D and I). It can also be seen that limiting the use of F4TCNQ to only a part of the entire hole transport layer (that is in either CTL1 or CTL2 but not both) and to lower concentrations (e.g. 0.025 wt % or lower) leads to desirable Vdd (<30 volts). In that regard, Samples E and K are observed to provide low Vr coupled with low Vdd.

| | CTL1 | | CTL2 | | | |
|---|---|---|---|---|---|---|
| | Thickness (% total | Weight % | Thickness (% total | Weight % | Properties | |
| Sample | CTL) | F4TCNQ | CTL) | F4TCNQ | Vdd | Vr |
| A | 10 | 0.017 | 90 | 0 | 24.54 | 5.28 |
| B | 50 | 0.017 | 50 | 0 | 35.48 | 3.32 |
| C | 50 | 0.017 | 50 | 0.017 | 41.47 | 1.7 |
| D (reference) | 50 | 0 | 50 | 0 | 21.12 | 12.74 |
| E | 50 | 0 | 50 | 0.017 | 27.84 | 1.38 |
| F | 90 | 0 | 10 | 0.017 | 21.76 | 6.96 |
| G | 10 | 0.025 | 90 | 0 | 42.55 | 4.21 |
| H | 50 | 0.025 | 50 | 0 | 40.65 | 2.13 |
| I (reference) | 50 | 0 | 50 | 0 | 20.93 | 15.43 |
| J | 10 | 0 | 90 | 0.025 | 37.74 | 1.90 |
| K | 50 | 0 | 50 | 0.025 | 24.83 | 1.78 |
| L | 50 | 0.030 | 50 | 0 | 49.47 | 2.33 |
| M | 50 | 0.030 | 50 | 0.030 | 72.39 | 2.54 |
| N | 50 | 0 | 50 | 0.030 | 33.59 | 1.90 |
| O | 90 | 0 | 10 | 0.030 | 26.64 | 12.52 |

Example 3

Preparation of Imaging Members

Imaging member sheets or belts are formed in the same manner as in Example 2. A control imaging member sheet is formed using no F4TCNQ, for comparison to an exemplary imaging member sheet formed using 0.050 weight % F4TCNQ in the first hole transport sub-layer (CTL1) and no F4TCNQ in the second hole transport sub-layer (CTL2).

Device performance is evaluated using time zero PIDC measurements and long tern electrical cycling over 10,000 cycles in ambient conditions, as in Example 2. The results show that for the exemplary imaging member sheet, the device containing the strong electron accepting material shows less cycling up; pointing to the increased cycling stability.

It will be appreciated that various of the above-disclosed and other features and functions, or alternatives thereof may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrophotographic imaging member comprising:

a substrate, a charge generating layer, a hole transport layer, and an optional overcoating layer wherein at least one layer of the electrophotographic imaging member comprises a strong electron acceptor material, the strong electron acceptor material is present in the at least one layer in a concentration gradient extending from one radial side of the at least one layer to another radial side of the at least one layer and the strong electron acceptor material is contained in the charge generating layer.

2. The electrophotographic imaging member of claim 1, wherein the at least one layer further comprises a hole transport material, and the strong electron acceptor material has an electron affinity as compared to the hole transport material of from about 2 to about 15 electron volts.

3. The electrophotographic imaging member of claim 1, wherein the strong electron acceptor material is contained in the hole transport layer.

4. The electrophotographic imaging member of claim 1, wherein the overcoating layer is present, and wherein the strong electron acceptor material is contained in the overcoating layer.

5. The electrophotographic imaging member of claim 3, wherein the hole transport layer further comprises a film-forming polymer.

6. The electrophotographic imaging member of claim 3, wherein the hole transport layer comprises a hole transport molecule selected from N,N'-diphenyl-N,N'-bis(3-methylphenyl)-(1,1'-biphenyl)-4,4'-diamine, N,N,N',N'-tetra-p-tolylbiphenyl-4,4'-diamine, and N,N'-Bis(3-methylphenyl)-N,N'-bis[4-(1-butyl)phenyl]-[p-terphenyl]-4,4'-diamine.

7. The electrophotographic imaging member of claim 6, wherein the hole transport layer comprises N,N'-diphenyl-N,N'-bis(3-methylphenyl)-(1,1'-biphenyl)-4,4'-diamine.

8. The electrophotographic imaging member of claim 6, wherein the strong electron acceptor material is tetrafluorotetracyanoquinonedimethane.

9. The electrophotographic imaging member of claim 1, wherein the at least one layer comprises at least two sub-layers, and the strong electron acceptor material is incorporated into the at least two sub-layers in different concentrations.

10. The electrophotographic imaging member of claim 1, wherein the at least one layer comprises at least two sub-layers, and the strong electron acceptor material is incorporated in at least one of the sub-layers and is absent from at least one other of the sub-layers.

11. The electrophotographic imaging member of claim 10, wherein a thickness ratio of a thickness of the at least one sub-layer containing the strong electron acceptor material to a thickness of the at least one other sub-layer not containing the strong electron acceptor material is from about 5:95 to about 95:5.

12. The electrophotographic imaging member of claim 10, wherein a thickness ratio of a thickness of the at least one sub-layer containing the strong electron acceptor material to a thickness of the at least one other sub-layer not containing the strong electron acceptor material is from about 25:75 to about 75:25.

13. The electrophotographic imaging member of claim 1, wherein the strong electron acceptor material is selected from the group consisting of tetracyanoquinonedimethane, Lewis acid compounds, fullerenes.

14. The electrophotographic imaging member of claim 1, wherein the strong electron acceptor material is selected from the group consisting of tetrafluorotetracyanoquinlonedimethane, $FeCl_3$ and $C_{60}$ fullerenes.

15. The electrophotographic imaging member oft claim 1, wherein the strong electron acceptor material is present in an amount of from greater than 0 to about 1.0% by weight of the total solid content of the at least one layer.

16. The electrophotographic imaging member of claim 1, wherein the strong electron acceptor material is present in an amount of from greater than 0 to about 1% by weight of the total solid content of the at least one layer.

17. The electrophotographic imaging member of claim 1, wherein the strong electron acceptor material is present in an amount of from greater than 0 to about 0.1% by weight of the total solid content of the at least one layer.

18. The electrophotographic imaging member of claim 1, wherein the electrophotographic imaging member exhibits a residual voltage of from about 0 to about 10 volts, and dark decay of from about 0 to about 30 volts.

* * * * *